US006278086B1

(12) United States Patent
Janouch et al.

(10) Patent No.: US 6,278,086 B1
(45) Date of Patent: Aug. 21, 2001

(54) HAIR STYLING APPLIANCE WITH RESILIENTLY MOUNTED PRESSURE MEMBER

(75) Inventors: Peter Janouch, Frankfurt am Main; Robert Jung, Friedberg; Dieter Liebenthal, Maintal; Jürgen Seng, Friedberg, all of (DE)

(73) Assignee: Braum GmbH, Kronberg (DE)

( * ) Notice: Subject to any disclaimer, the term of this patent is extended or adjusted under 35 U.S.C. 154(b) by 0 days.

(21) Appl. No.: 09/548,111

(22) Filed: Apr. 12, 2000

Related U.S. Application Data

(63) Continuation of application No. PCT/EP98/06542, filed on Oct. 15, 1998.

(30) Foreign Application Priority Data

Nov. 13, 1997 (DE) ..... 197 50 119

(51) Int. Cl.[7] ..... A45D 1/04
(52) U.S. Cl. ..... 219/222; 132/231; 132/269
(58) Field of Search ..... 219/225, 222; 132/227–232, 269

(56) References Cited

U.S. PATENT DOCUMENTS

| | | | |
|---|---|---|---|
| 1,539,313 | 5/1925 | Homer . | |
| 1,650,952 | 11/1927 | Mead . | |
| 1,757,245 | 5/1930 | Headington . | |
| 1,865,655 | 7/1932 | Walsh . | |
| 4,163,143 | 7/1979 | Federico et al. . | |
| 4,426,567 | 1/1984 | Gugliotti . | |
| 4,561,455 * | 12/1985 | Pajak | 132/232 |

FOREIGN PATENT DOCUMENTS

| | | | |
|---|---|---|---|
| 317 466 | 12/1973 | (AT) . | |
| 266832 | 10/1913 | (DE) . | |
| 619 088 | 10/1994 | (EP) . | |
| 2 312 840 | 11/1997 | (GB) . | |
| 3798 * | 9/1919 | (NL) | 219/225 |
| 1687241 * | 10/1991 | (SU) | 219/225 |

* cited by examiner

*Primary Examiner*—John A. Jeffery
(74) *Attorney, Agent, or Firm*—Fish & Richardson P.C.

(57) ABSTRACT

A hair styling appliance includes a handle portion, a heating portion for heating the hair, and a holding member (1), with the latter being movable into an open and a closed condition. The hair can be placed in between the heating portion and the holding member (1) for styling. A pressure member (2) for exerting a pressure force on the hair is arranged between the heating portion and the holding member (1).

19 Claims, 3 Drawing Sheets

HAIR STYLING APPLIANCE WITH RESILIENTLY MOUNTED PRESSURE MEMBER

This application is a continuance of PCT EP98/06542 filed Oct. 15, 1998.

BACKGROUND OF THE INVENTION

The present invention relates to a hair styling appliance including a handle portion, a heating portion for heating the hair, and a holding member which can be moved from an open to a closed condition, with the hair being adapted to be placed between the heating portion and the holding member.

A hair styling appliance of this type is disclosed in U.S. Pat. No. 4,426,567. In this patent, a handle is provided on which an electrically operated heating element is retained. The heating element has an elongated configuration and serves to heat a user's hair. A scissors-type clamping member is pivotally mounted roughly in the transition area between the handle and the heating element. The clamping member has also an elongated design and is adapted in its shape to the heating element. The clamping member can be swivelled by a user to a closed condition and an open condition by means of an actuating lever. Hair may be placed in between the heating element and the clamping member in the open condition. Hair may then be wrapped around the heating element and styled in this way.

U.S. patent application Ser. No. 1,865,655 discloses an electrically operated hair curling iron of the type initially referred to, wherein the holding member is pivotable about a bearing provided on the handle portion until the holding member will abut on the surface of the heating portion. The holding member is connected to two oppositely arranged clamping members which can be tilted manually in relation to the longitudinal axis of the holding member so that they bear against the surface of the heating portion and partly embrace it, when the holding member is in abutment on the heating portion. Hair rolled up on the heating portion will thus be pressed by the clamping members against the surface of the heating portion.

When hair is disposed between the heating element and the clamping member, it is pressed against the heating element by the clamping member when in the closed condition. The pressure force exerted on the hair depends on the distance between the hair and the tilting axis. Thus, a higher pressure force acts upon the hair proximate the tilting axis than spaced farther away therefrom. This renders it impossible in the prior art hair styling tool to press the hair evenly against the heating element over the entire length of the clamping member.

An object of the present invention is to provide a hair styling element which permits a uniform application of the hair against the heating barrel.

SUMMARY OF THE INVENTION

According to the present invention, this object is achieved in a hair styling element of the type mentioned hereinabove by the provision of a pressure member for exerting a pressure force on the hair which is arranged between the heating portion and the holding member and by the pressure member being resiliently retained on the hair styling appliance. Thus, a separate pressure member is provided for exerting pressure on the hair which is independent of the holding member. This offers the advantage that the pressure force is also independent of the holding member. It is thereby achieved that it is insignificant with a tiltable holding member how far the hair being pressed is spaced from the tilting axis. Instead, the pressure member applies a uniform pressure on the hair over the entire length of the holding member. The said uniform pressure application on the hair is produced by the resilient pressure member arranged between the heating portion and the holding member, as mentioned above. This may be realized in different ways.

For example, it is possible to provide an elastically deformable pressure member which is pushed back by the hair that is put into the appliance. In this case, the pressure force depends on the deformability or, respectively, elasticity of the pressure member. It is also possible to support the pressure member in a resilient manner so that, with hair put in the appliance, the spring, being configured as a pressure spring or helical spring, leaf spring, rubber-elastic or resilient element, or a similar element, is compressed and thereby causes displacement of the pressure member. The pressure force depends on the spring rate of the spring in this case. This achieves the advantage that the pressure force exerted by the pressure member can be adjusted as desired. Thus, the pressure force may e.g. be influenced by a corresponding deformability or, respectively, elasticity of the pressure member itself, or by a corresponding spring rate of the spring which provides the mounting support for the pressure member. As explained hereinabove, the adjustment of the pressure force is independent of the holding member in all cases. Thus, a hair styling appliance is achieved with the pressure member that is arranged between the heating portion and the holding member and exerts a pressure force on the hair which renders it possible that a predeterminable pressure force is uniformly applied to the hair.

In a favorable embodiment of the present invention the pressure member is held resiliently on the holding member, and the hair can be placed between the heating portion and the pressure member. Thus, the pressure member is coupled to the holding member and forms a unit with it. In this case, the hair is placed between the heating portion and the pressure member and may then be wrapped around the heating portion or around the pressure member and the holding member. The advantage of this embodiment is its simple construction. Further, this embodiment of a hair styling appliance lends itself to special ease of handling by a user.

In another favorable embodiment of the present invention, the pressure member is held resiliently on the heating portion, and the hair can be placed between the holding member and the pressure member. Thus, the pressure member is associated with the heating portion. This may be achieved, for example, because the pressure member is integrated in the heating portion and, in case of need, will even be heated. In this case, the hair is placed intermediate the pressure member and the holding member. It is advantageous in this embodiment of a hair styling appliance that a user will notice almost no difference as regards the appearance and handling in comparison to prior art appliances.

In a preferred aspect of the present invention the heating portion has an axis, there is provision of a guiding means to radially guide the pressure member. The heating portion is configured as an elongated heating barrel, for example. It is achieved by the guiding of the pressure member, which is radial with respect to the barrel, that an especially uniform pressure is applied by the pressure member to the hair. The hair is this way pressed uniformly against the heating portion over the entire length of the holding member especially when the pressure member is associated with the holding member.

In a favorable embodiment of the present invention the pressure member is mounted with two springs, rubber elements, or similar elastic means, fitted especially on the opposite ends of the pressure member. It is thereby achieved that the pressure member exerts a generally uniform pressure force on the hair even in the event of load application on a single side. This improves the uniform pressure application still further.

It is especially appropriate when the springs are arranged so that they produce a resilient force in a radial direction. This renders it possible in particular to predefine with relative precision the effect of the resilient force on the hair. An exact and reproducible adjustment of the resilient force and, thus, of the pressure force acting on the hair is thereby facilitated.

A stop on which the holding member abuts in the closed condition is provided in a particularly favorable embodiment of the hair styling appliance of the present invention.

This stop may be provided proximate the free end of the hair styling appliance, that is, for example, at the end of a swivellable holding member remote from the tilting axis. However, it is also possible that the stop is provided proximate the handle portion of the hair styling appliance, that is, for example, with a swivellable holding member, proximate the actuating lever connected to the holding member. Especially in the last mentioned possibility, the stop can be configured as a barb or a similar element.

In a preferred aspect of the present invention, the pressure member is displaceable between a position where it abuts on the heating portion or on the holding member and a position where it produces a gap when the holding member is in abutment on the stop.

With no hair put in the appliance, the pressure member bears against the holding member or, respectively, the heating portion when in the closed condition. When the holding member is now opened, hair may be placed into the appliance. When the pressure member is fitted to the holding member, the pressure member will be shifted back by the hair in the direction of the holding member when the holding member is closed, and will thus open the above-mentioned gap. The hair is then pressed between the pressure member and the heating portion. When, in contrast thereto, the pressure member is a component part of the heating portion, the pressure member will be shifted back in the direction of the heating portion when the holding member is closed, and will thus open the above-mentioned gap. The hair is then pressed between the pressure member and the holding member.

The pressure force exerted on the hair in both cases is absolutely independent of the holding member. This is due to the holding member bearing against the stop. A spring, or a similar element, which may act upon the holding member will have as an effect only that the holding member is urged against the stop. However, due to the stop, the spring is not allowed to take influence on the application of pressure on the hair. As has already been explained hereinabove, the pressure force exerted on the hair is thus independent of the holding member or, respectively, depends only on the pressure member and said's configuration.

It is especially suitable when there is provision of a limiting means for a maximum gap. In case too much hair is placed in the hair styling appliance, the pressure member will be pressed against its limiting means when the holding member is closed. The result is that the holding member is lifted from its stop, and the hair styling appliance is thereby reopened by the hair. This prevents that an excessive quantity of hair is placed into the hair styling appliance. Or, a like situation is at least indicated to a user.

According to another aspect of the invention, it is favorable when the pressure force of the holding member on the stop exceeds the pressure force which the pressure member applies to the hair. It is achieved this way that, first of all, the pressure member will always be pushed back by the hair put into the appliance, and only afterwards, in case too much hair is put in, will the holding member be lifted and thus opened. When springs are used, the different pressure forces can be adjusted by corresponding spring rates. Further, there is the advantageous possibility of individual adjustment of the pressure force of the spring by a user. For example, the spring bias of the corresponding adjusting means, such as screws, or like elements, may be individually variable.

The pressure member is retained so as to be detachable in a preferred aspect of the present invention. This renders it possible to remove the pressure member e.g. for cleaning purposes, or for replacement. It is likewise possible to use different structural embodiments, especially different geometrical shapes of the pressure member.

Further features, possible applications and advantages of the present invention can be seen in the following description of embodiments of the present invention which are illustrated in the Figures of the accompanying drawings. All features described or illustrated, per se, or in any desired combination, represent the object of the present invention, irrespective of their combination in the patent claims and irrespective of their formulation or representation in the description or in the drawings.

DETAILED DESCRIPTION

Figure 1:
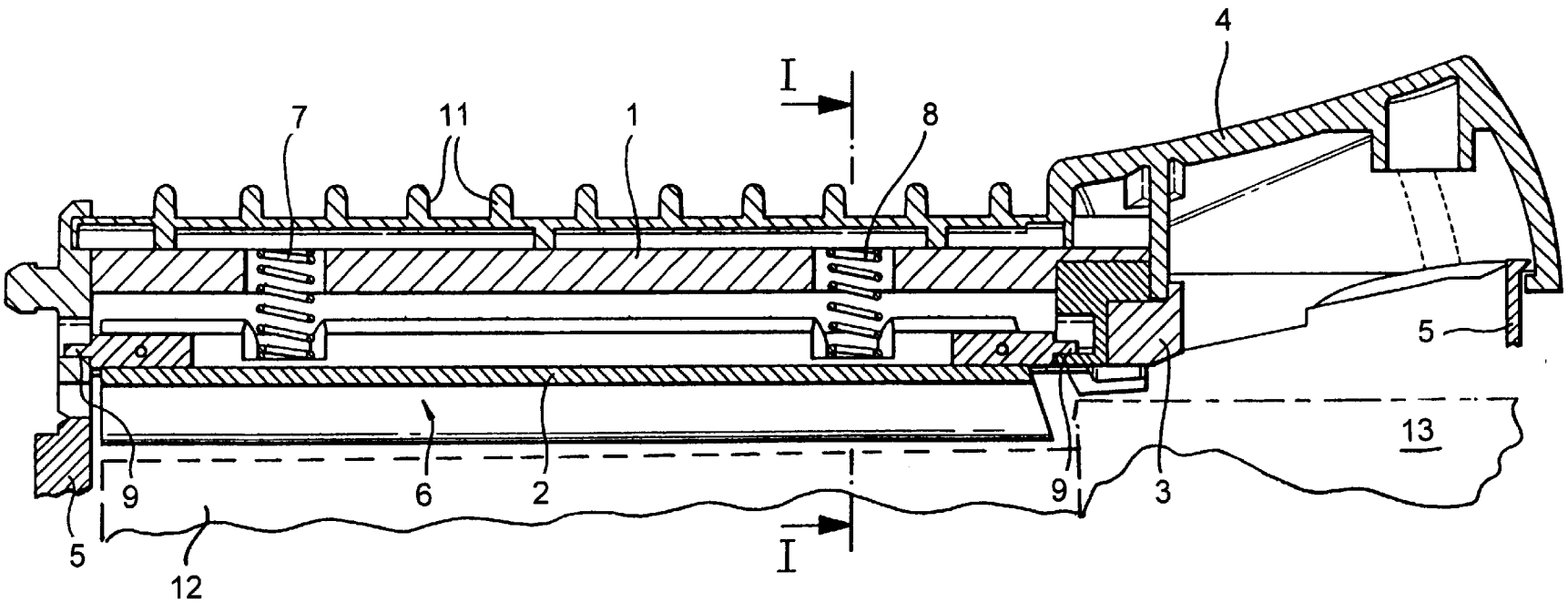
FIG. 1 is a schematic longitudinal cross-sectional view of an embodiment of a part of a hair styling appliance according to the present invention.
Figure 1A:
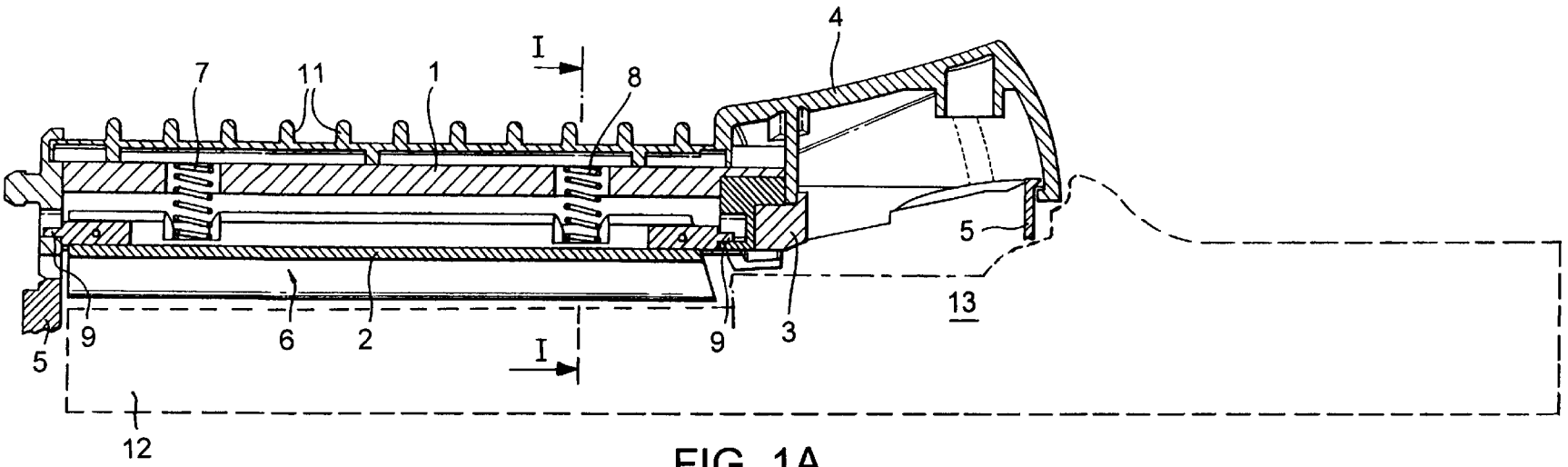
FIG. 1A is a schematic side view of a hair styling appliance incorporating the hair styling appliance part illustrated in FIG. 1.

A hair styling appliance FIG. 1A is usually comprised of a handle portion 13 and a heating portion 12. The heating portion 12 (shown in dotted lines in FIG. 1 ) is fitted to the handle portion 13 and can be heated electrically or gas-operated. The heating portion 12 is configured as an elongated heating barrel with a generally circular cross-section. A longitudinal axis of the hair styling appliance is defined by the heating portion 12.

Figure 2:
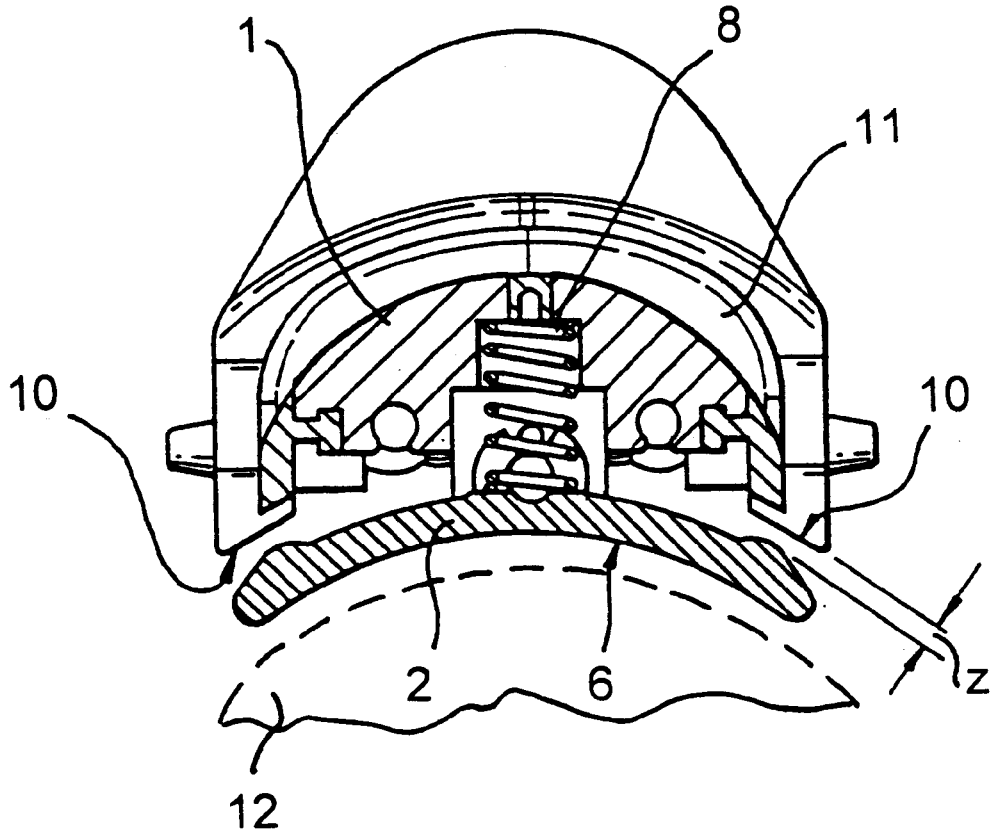
FIG. 2 is a schematic cross-section taken through the part of the hair styling appliance of FIG. 1 along the plane I—I in FIG. 1.

The embodiments of FIGS. 1 and 2 show a holding member 1 with a pressure member 2 associated with it. The holding member 1 and the pressure member 2 have an elongated design, and their length roughly equal to the length of the heating portion 12. The holding member 1 and the pressure member 2 are interconnected and form a unit in this respect.

The holding member 1 is pivotally mounted by way of a bearing 3 roughly in the area of transition between the heating portion 12 and the handle portion 13. Further, the holding member 1 includes an actuating lever 4 which is arranged proximate the handle portion 13 and is associated with it. By means of the actuating lever 4, a user can move the holding member 1 with the pressure member 2 from a closed condition to an open condition, and vice versa. In the closed condition, the holding member 1 with the pressure member 2 bears against the heating portion 12. In the open condition, the holding member 1 with the pressure member 2 is swung away from the heating portion 12 and no longer abuts thereon.

Proximate the actuating lever 4, a spring (not shown) is provided and supported on the handle portion 13 and the actuating lever 4 so that the holding member 1 is always urged by the spring into the closed condition. Further, a stop 5 is provided on the heating barrel 12 proximate the free end of the holding member 1, on which stop the holding member 1 abuts in the closed condition. Stop 5 can be seen from FIG. 1 in particular. Due to the above-mentioned spring which acts upon the actuating lever 4, the holding member 1 in the closed condition is urged against the stop 5 by a pressure force that depends on the spring rate of the spring. Instead of the stop 5, a barb (not shown), or a like element, that is coupled to the holding member 1 can also be provided proximate the handle portion 13 and the actuating lever 4.

The pressure member 2 has an elongated design and, advantageously, an arcuate cross-section. This can be taken from FIG. 2 in particular. Of course, other geometrical shapes adapted to the geometry of the heating portion 12 are also possible. With its surface 6, pressure member 2 bears against the heating portion 12 in the closed condition. The geometry of surface 6 is adapted to the heating portion 12 for this purpose.

The pressure member 2 is connected to the holding member 1 by way of especially two or more springs 7, 8. Springs 7, 8 are arranged proximate the ends of the pressure member 2 and, thus, also proximate the ends of the holding member 1. Further, springs 7, 8 are aligned in about radially relative to the longitudinal axis of the heating portion 12 and, thus, also in about radially relative to the pressure member 2. Springs 7, 8 are slipped on pins which project from the holding member 1 and the pressure member 2, for example. This makes the pressure member 2 detachable from the holding member 1, it can be removed therefrom and replaced, if necessary.

The holding member 1 and the pressure member 2 include at their two ends in each case a guiding means 9 by which the pressure member 2 is guided in a radial direction. This permits displacement of the pressure member 2 in a radial direction, which can be taken from FIG. 1 in particular. In addition, a certain degree of tiltability of the pressure member 2 about its longitudinal axis can be achieved by a corresponding configuration of the guiding means 9.

In the open condition of the holding member 1, the pressure member 2 is urged away from the holding member 1 by springs 7, 8. A distance z is produced between the pressure member 2 and a limiting means 10 provided on the holding member 1. This is illustrated in FIG. 2 in particular. The pressure member 2 can be urged by this distance z into the holding member 1 until it bears against the limiting means 10.

When the holding member 1 is closed without hair being put into the appliance, the holding member 1 will abut on the stop 5, and the pressure member 2 with its surface 6 bears against the heating portion 12. This condition is maintained by the spring which acts on the actuating lever 4. This is the condition in which the hair styling appliance is usually stored or transported.

In use, the holding member 1 is opened, and a user places the hair to be styled between the heating portion 12 and the opened holding member 1. Subsequently, the holding member 1 is closed and, as explained hereinabove, pressed against the stop 5 by the resilient force of the spring associated with the actuating lever 4. In closing, the pressure member 2 is pushed back by the hair put into the appliance in the direction of the holding member 1, and thus displaced in a radial direction. The distance z between the pressure member 2 and the limiting means 10 is thus decreased. This equally implies that a gap is produced between the pressure member 2 and the heating portion 12 in which the hair put in is clamped.

A user may style the hair put in the appliance in this condition. The hair is heated by the heating portion 12 and pressed against the heating portion 12 by the pressure member 2. The pressure force which acts on the hair is only dependent on the spring rates of the two springs 7, 8. Due to stop 5, this pressure force does not depend on the holding member 1 or the spring that acts on the actuating lever 4. A uniform pressure force that is exerted on the hair over the entire length of the pressure member 2 is achieved by using equal springs 7, 8 at the respective ends of the holding member 1 and the pressure member 2.

Now the user may wrap the hair around the heating barrel 12 or the holding member 1 for styling. Essentially, only the resilient force of the springs 7, 8 will act when the hair is clasped by or pulled through the hair styling appliance in such a manner. The resilient force of the spring that acts on the actuating lever 4 is practically of no importance. Also, the pressure force acting on the hair is essentially irrespective of the hair being wrapped around the holding member 1.

In case a user places too much hair between the heating portion and the pressure member 2, the result is that the pressure member 2 is pressed completely into the holding member 1 when the holding member 1 is closed. Hence, the pressure member 2 will move into abutment on the limiting means 10 so that the distance z becomes zero. This equally implies that a maximum gap is produced between the heating portion and the pressure member 2 which, however, is not sufficient to take up the hair put into the appliance.

The excessive quantity of hair put in will then cause the holding member 1 to lift from the stop 5 in opposition to the resilient force of the spring that acts on the actuating lever 4. This will indicate to a user that he/she put in too much hair into the hair styling appliance so that the action can now be repeated.

The spring rates of the springs 7, 8 are of equal size and so chosen as is desired for pressing the hair against the heating portion 12. The spring rate of the spring that acts on the actuating lever 4 is higher, especially considerably higher than the spring rates of the springs 7, 8 in order that the pressure member 2 will in any case be first shifted entirely into the holding member 1 by the hair put into the appliance before the holding member 1 will lift from stop 5.

What is claimed is:

1. A hair styling appliance comprising a handle portion, a heating portion, a holding member which can be moved from an open to a closed condition, with the hair appliance being adapted to receive hair placed in between the heating portion and the holding member and a pressure member for exerting a pressure force on the hair arranged between the heating portion and the holding member, in the pressure member being retained on the hair styling appliance in a resilient manner wherein the pressure member, including both lateral sides thereof, is displaceable relative to the holding member and the heating portion.

2. The hair styling appliance as claimed in claim 1, wherein the pressure member is retained on the holding member, with the hair appliance being adapted to receive hair placed in between the heating portion and the pressure member.

3. The hair styling appliance of claim 2, further comprising a biasing member acting to bias the pressure member away from the holding member.

4. The hair styling appliance as claimed in claim 1, wherein the pressure member is retained on the heating portion, with the hair appliance being adapted to receive hair placed in between the holding member and the pressure member.

5. The hair styling appliance as claimed in claim 1, wherein the heating portion includes a guiding device for radially guiding the pressure member along an axis.

6. The hair styling appliance as claimed in claim 1, wherein the pressure member is retained by two springs that are arranged on the opposed ends of the pressure member.

7. The hair styling appliance as claimed in claim 6, wherein the two springs are arranged so that they produce a resilient force in a radial direction.

8. The hair styling appliance as claimed in claim 1, wherein a stop is provided on which the holding member abuts in the closed condition.

9. The hair styling appliance as claimed in claim 8, wherein the pressure member is movable between a position where it abuts on the heating portion and a position where it produces a gap with the holding member when the holding member abuts on the stop.

10. The hair styling appliance as claimed in claim 9, wherein a limiting device for the gap is provided to define a maximum gap.

11. The hair styling appliance as claimed in claim 8, wherein the holding member is urged against the stop.

12. The hair styling appliance as claimed in claim 11, wherein a pressure force of the holding member on the stop exceeds a pressure force which the pressure member (2) applies to hair received in the hair styling appliance.

13. The hair styling appliance as claimed in claim 1, wherein the pressure member is detachably mounted.

14. The hair styling appliance of claim 1, wherein the heating portion defines a longitudinal axis and the longitudinal ends of the pressure member are displaceable relative to the holding member and heating portion to permit displacement along or tilt about an axis transverse to the longitudinal axis.

15. The hair styling appliance of claim 1, wherein the pressure member is supported solely in a central region inward of both peripheral lateral sides.

16. The hair styling appliance of claim 1, wherein the pressure member extends substantially from one lateral side to the other lateral side of an interface between the holding member and the heating portion.

17. The hair styling appliance of claim 1, wherein the holding member defines a central longitudinal axis and the pressure member is mounted to permit tilting motion in both clockwise and counterclockwise directions about the central longitudinal axis.

18. The hair styling appliance of claim 1, wherein the heating portion is operated by one of gas or electricity.

19. The hair styling appliance of claim 1, wherein the pressure member is displaceable along a first axis and rotationally displaceable about a second and a third axis, the first axis being normal to one of the holding member and the heating member, the second and third axes being normal to each other and each being normal to said first axis.

* * * * *

UNITED STATES PATENT AND TRADEMARK OFFICE

CERTIFICATE OF CORRECTION

PATENT NO. : 6,278,086 B1
DATED : August 21, 2001
INVENTOR(S) : Peter Janouch et al.

It is certified that error appears in the above-identified patent and that said Letters Patent is hereby corrected as shown below:

Title page,
Item [73], Assignee, "Braum" should read -- Braun --.

Column 6,
Line 61, delete "in" after "member,"

Signed and Sealed this

Fifth Day of August, 2003

JAMES E. ROGAN
*Director of the United States Patent and Trademark Office*